US005467719A

United States Patent [19]

Dalrymple et al.

[11] Patent Number: 5,467,719

[45] Date of Patent: Nov. 21, 1995

[54] METHOD AND APPARATUS FOR SECURING A TANK TO A TANK CAR SILL

[75] Inventors: Thomas H. Dalrymple, Duncanville; Christopher C. Harkey, Dallas, both of Tex.

[73] Assignee: Trinity Industries, Inc., Dallas, Tex.

[21] Appl. No.: 282,315

[22] Filed: Jul. 29, 1994

[51] Int. Cl.[6] ..... B61D 49/00

[52] U.S. Cl. ..... 105/362

[58] Field of Search ..... 105/358, 359, 105/360, 361, 362; 296/35.1, 29, 209

[56] References Cited

U.S. PATENT DOCUMENTS

| | | | |
|---|---|---|---|
| 2,338,925 | 1/1944 | Garlock et al. | 105/362 |
| 3,631,815 | 1/1972 | Heap | 105/362 |
| 3,685,458 | 8/1972 | Price et al. | 105/360 |
| 4,557,199 | 12/1985 | Everett | 105/362 |
| 4,805,540 | 2/1989 | Mundloch et al. | 105/358 |
| 5,351,625 | 10/1994 | Culligan et al. | 105/362 |

OTHER PUBLICATIONS

Trinity Industries, Inc. Drawing B–120002 of a Head Brace (circa 1980).

Trinity Industries, Inc. Drawing D–140213 of a Draft Sill (circa 1980).

Photographs of a prototype car built by Trinity Industries, Inc. (circa 1980).

Union Tank Car Publication (date unknown) p. 381.

*Primary Examiner*—Mark T. Le

*Attorney, Agent, or Firm*—Baker & Botts

[57] ABSTRACT

A method for attaching a head brace to a tank car includes cutting a portion of the draft sill near the position where the head brace is to be located in order to create an access opening. The interior of the head brace is welded to the draft sill assembly and front sill pad through the access opening. The exterior of the head brace may also be welded to the draft sill assembly and front sill pad. An apparatus for attaching a portion of tank to railway car includes a head brace and draft sill formed with an access opening.

17 Claims, 3 Drawing Sheets

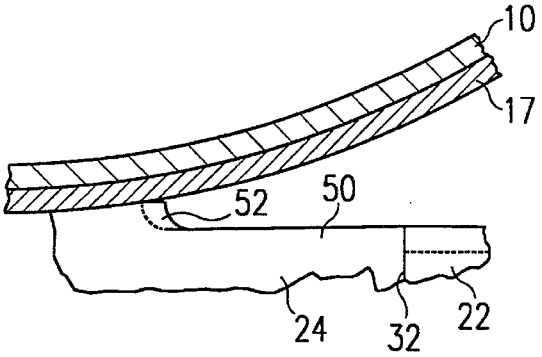
FIG. 4
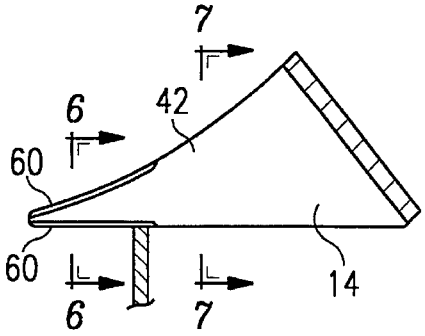
FIG. 5
FIG. 6
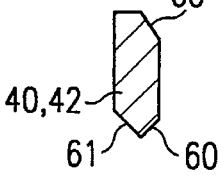
FIG. 7
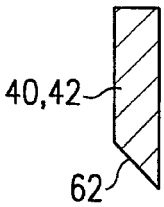
FIG. 8
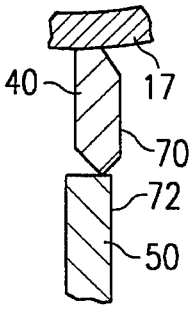
FIG. 9
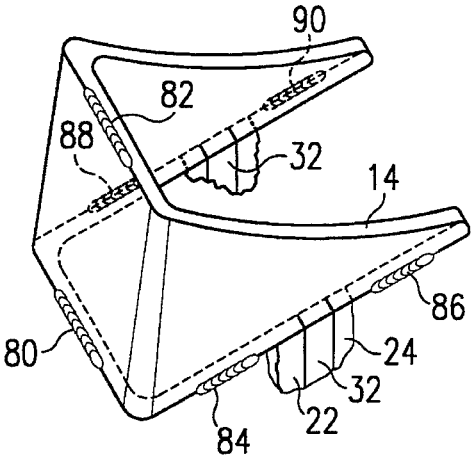
FIG. 10
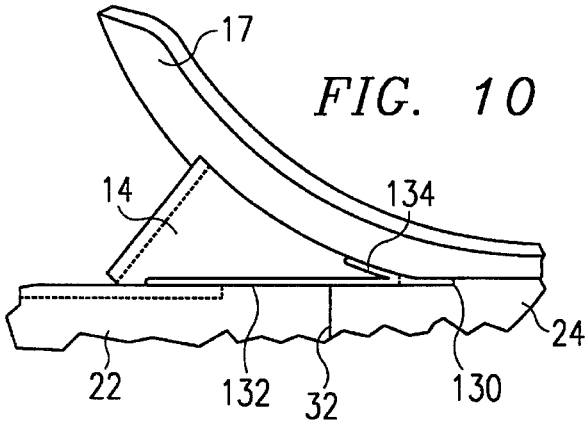

FIG. 11
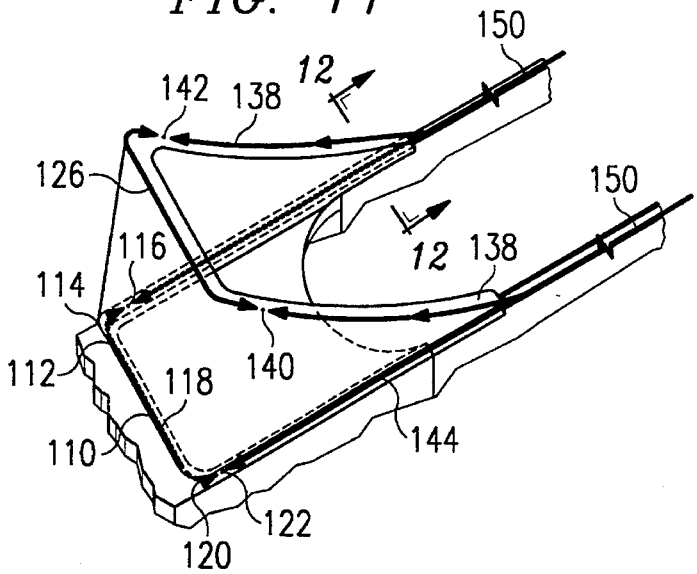
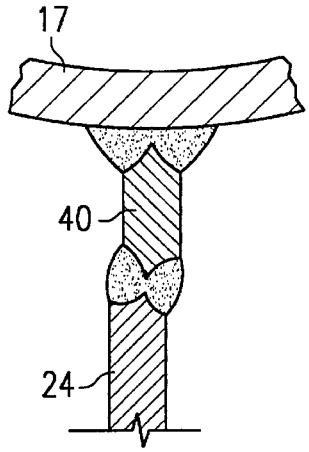
FIG. 12
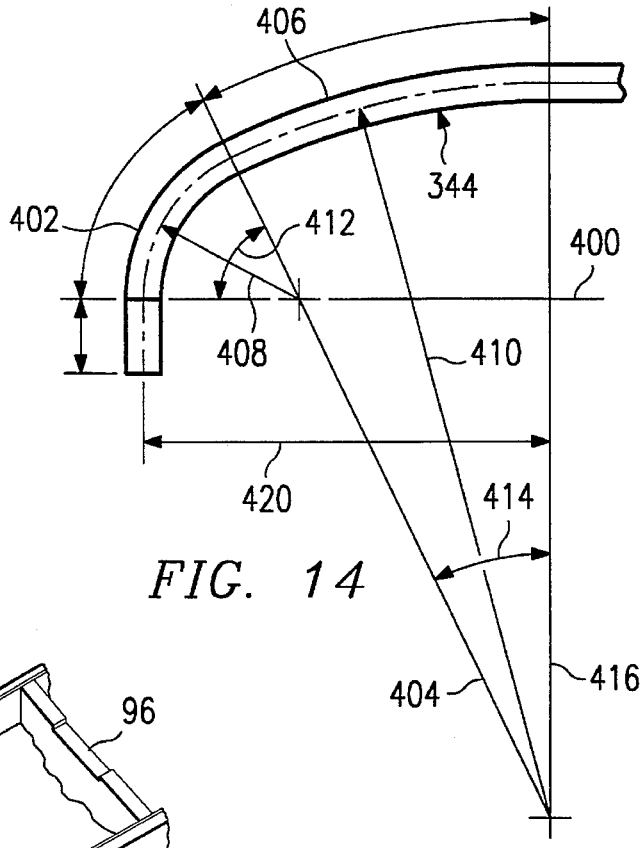
FIG. 14
FIG. 13
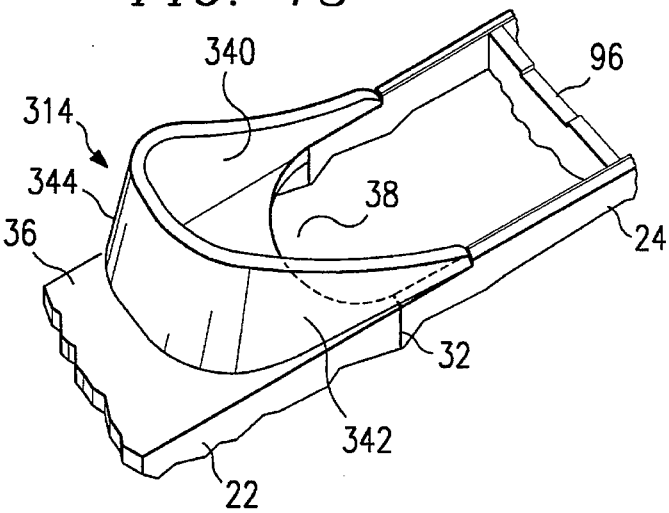

METHOD AND APPARATUS FOR SECURING A TANK TO A TANK CAR SILL

TECHNICAL FIELD OF THE INVENTION

This invention relates in general to the field of railway tank cars, and more particularly, to methods and apparatuses for securing the tank to the sill or sills of a tank car.

BACKGROUND OF THE INVENTION

Railway tank cars may be used for carrying a variety of liquid, gaseous, and semi-liquid ladings. Such railway tank cars often include a horizontal, generally cylindrical tank. For center stub sill or draft sill type tank cars, the tank not only carries the lading, but is also used as a primary .structural member by the railway car to carry longitudinal train loads. These cars typically have center stub sills or draft sills on each end of the car along with transverse bolster assemblies. The draft sills carry couplers at their outer ends and have truck assemblies pivotally connected thereto for rolling support of the ends of the tank car on the railway tracks. Saddle assemblies, or cradle assemblies, are typically provided at each end of the car. The saddle assembly usually comprises a circumferential saddle extending arcuately and transversely up from the bottom of the car and mating with a saddle pad, or bolster pad, that is attached to the tank. The saddle and saddle pad are typically of steel plate construction and conformed to fit onto the adjacent outer surface of the cylindrical tank. Each end of the tank typically also has a head pad, or front sill pad.

The pads, such as the front sill pad and saddle pad, serve to distribute the loads and stresses over a larger area and to help prevent rupture of the associated tank. The connection between the pads and the tank is designed to be stronger than between the pads and other components welded to the pad. This arrangement enhances safety by making rupture of the tank less likely.

In securing the front sill pad to the draft sill, fillet and groove welds on the exterior of the head brace have conventionally been used. The head brace is typically a U-shaped, wedge-like piece that is placed between the front sill pad and portions of the draft sill to facilitate attachment of the tank to the draft sill, and to reduce the geometric stress concentrations at the outboard attachment points. As noted above, it has typically been conventional to apply the head brace with welding only on the exterior of the head brace. This attachment has been sufficient to meet the strength criteria required by the Association of American Railroads (AAR).

In recent times, the tank car industry has discovered a significant number of fatigue cracks on the head braces or the connections associated with the head braces. The frequency of fatigue cracks in this area may be as high as fifty percent of tank cars that have been on the railway tracks for a sufficient time period.

SUMMARY OF THE INVENTION

Therefore, a need has arisen for a method and apparatus for securing a tank to a railway car that substantially eliminates or reduces the disadvantages and problems associated with conventional techniques and apparatus for securing a tank to a railway tank car. In accordance with the present invention, a method and apparatus for securing a tank to a railway car is provided that substantially eliminates or reduces disadvantages and problems associated with previously developed apparatuses and methods.

According to one aspect of the present invention, a method for attaching a head brace to a front sill pad on a tank is provided that includes the steps of cutting a top portion of a draft sill near where a tail portion of the head brace will be placed to form an access opening; welding the interior of the head brace to the front sill pad and to the draft sill through the access opening; and welding the exterior of the head brace to the draft sill and front sill pad. According to another aspect of the present invention, the head brace may be gouged and then welded to provide a substantially metal-on-metal connection between the front sill pad, head brace, and draft sill.

According to another aspect of the present invention, a head brace is contoured or curved to better distribute forces throughout the head brace and associated front sill pad. According to another aspect of the present invention, an apparatus for securing a tank with a front sill pad to a draft sill is provided that includes a head brace and a draft sill formed to have an access opening for allowing welding of an interior portion of the head brace to the draft sill.

Among the technical advantages of the present invention is that it may provide an easy means and apparatus for securing a head brace to a tank of a railway tank car that will reduce the possibility of fatigue cracks or otherwise extend the service life of the railway car. Another technical advantage of the present invention is that it provides an improved path for distribution of loads applicable to the head brace.

BRIEF DESCRIPTION OF THE DRAWINGS

For a more complete understanding of the present invention, and the advantages thereof, reference is now made to the following descriptions taken in conjunction with the accompanying drawings, in which:

FIG. 4 is an enlarged cross-section of a portion of a tank and a draft sill according to an aspect of the present invention;

FIG. 5 is a cross-sectional view taken about a longitudinal mid-line of a head brace according to an aspect of the present invention;

FIG. 6 is a cross-sectional view taken about line 6—6 of FIG. 5;

FIG. 7 is a cross-sectional view taken about line 7—7 of FIG. 5;

FIG. 8 is a cross-sectional view through a portion of the head brace tail according to an aspect of the present invention;

FIG. 9 is a perspective view of a head brace according to an aspect of the present invention showing the use initial tack welds;

FIG. 10 is an elevational view of a head brace according to an aspect of the present invention showing gouging on portions of the head brace;

FIG. 11 is a perspective view of a head brace according to an aspect of the present invention showing one pattern of exterior welds;

FIG. 12 is a cross-sectional view of a portion of the front sill pad, head brace, and a portion of the draft sill according to an aspect of the present invention;

FIG. 13 is a perspective view of another head brace according to an aspect of the present invention; and FIG. 14 is a schematic showing curvature that may be applied to a head brace according to an aspect of the present invention.

DETAILED DESCRIPTION OF THE INVENTION

The preferred embodiment of the present invention and its advantages are best understood by referring to FIGS. 1–14 of the drawings, like numerals being used for like and corresponding parts of the various drawings.

Figure 1:
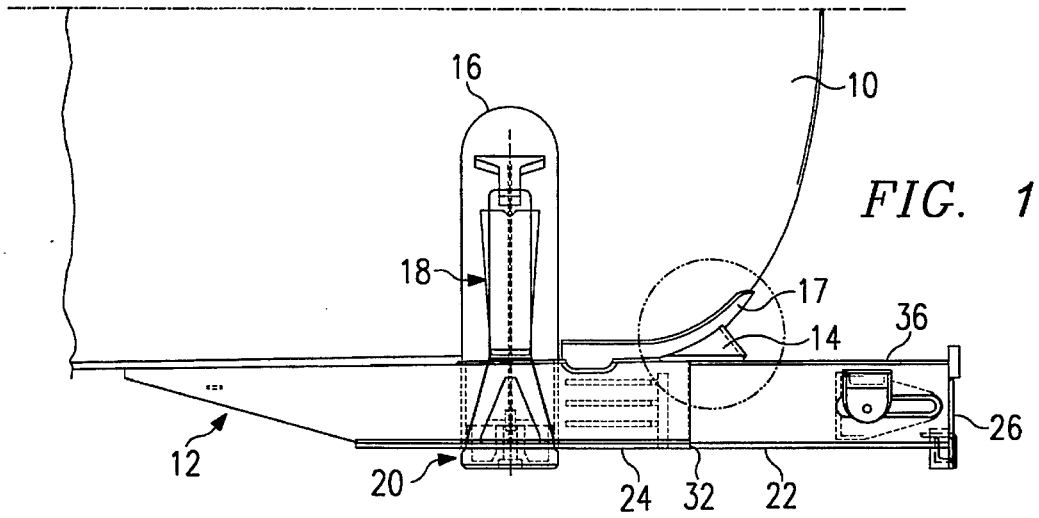
FIG. 1 is a partial elevational view of a tank car showing a draft sill, head brace and front sill pad attached to a portion of the tank according to an aspect of the present invention.

Referring now to FIG. 1, tank 10 of a railway tank car is shown secured to a draft sill assembly 12. The railway tank car described herein is conventional with the exception of aspects of head brace 14 and portions of draft sill assembly 12, which will be described in detail below. The remaining portions of the railway tank car are not described in detail as they are known in the art.

Railway tank car 10 has a bolster pad, or saddle pad 16, secured to tank 10. A saddle or cradle 18 is secured to bolster pad 16 to assist; in attaching tank 10 to draft sill assembly 12 and to support the weight of tank 10, the contents of the tank, and associated equipment. A front sill pad, or head pad 17, is secured to tank 10 and also assists in attaching tank 10 to draft sill assembly 12. Saddle or cradle 18 is formed as an integral part of bolster assembly 20. Bolster assembly 20 includes portions that are transverse and connected to draft sill assembly 12.

Draft sill assembly 12 may include a first portion 22 (or end portion) formed of a "CZ" bar, which is a Z-shaped structural member. Draft sill assembly 12 may include a second portion 24, which may be formed from a plurality of plates or draft sill plates. The end portion, or first portion 22, of draft sill assembly 12 forms a portion of a draft pocket which is where the draft gear (not shown) is placed. A draft gear is a cushioning device that goes in the draft sill assembly 12 and attaches to coupler assembly (not shown) for handling the longitudinal loads developed in the train. Again, the details of the draft gear and coupler as well as other aspects are not described in detail as they are known in the art.

Figure 2:
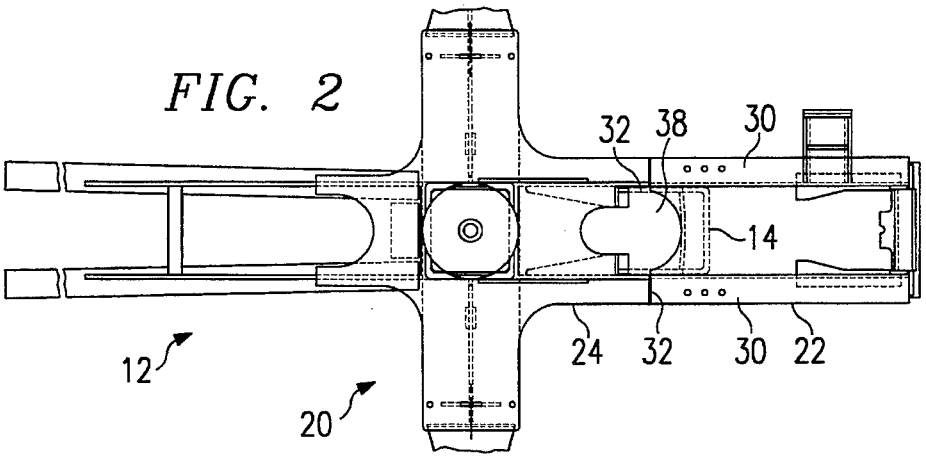
FIG. 2 is a bottom view of a draft sill for a railway tank car according to an aspect of the present invention.

Referring now to FIG. 2, draft sill assembly 12 may be seen from the bottom. First portion 22 is formed of CZ-bars or members that have been welded about a top portion to form a "top-hat" configuration; the top-hat configuration has bottom flanges 30 that may be seen from this view. The CZ-bars of first portion 22 are secured to second portion 24 by welding at the intersection shown by reference numeral 32. As previously noted, the two CZ-members of first portion 22 are welded to form a top-hat portion or configuration; the top portion of the top-hat forms a first top surface 36 as shown in FIGS. 1 and 3.

Figure 3:
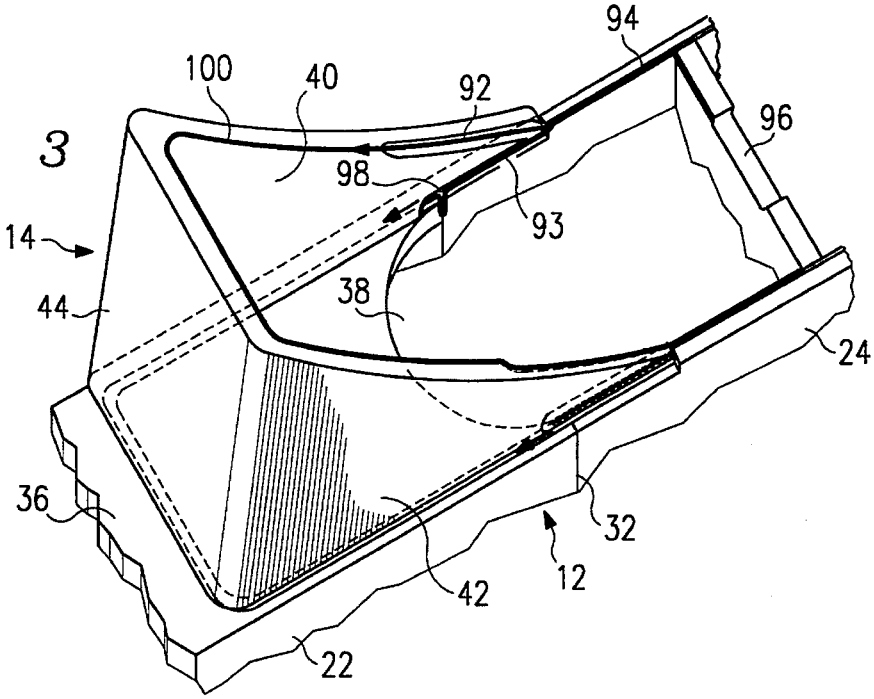
FIG. 3 is a perspective view of a head brace and a portion of a draft sill according to an aspect of the present invention.

Referring now to FIG. 3, head brace 14 is shown resting on a portion of draft sill assembly 12. An important aspect of the present invention includes cutting top surface 36 of first portion 22 to form an access opening 38 in draft sill 12. Access opening 38 will be used to access the interior of head brace 14 as will be described below. Access opening 38 is coped in top surface 36 of first portion 22. Access opening 38 may take any of numerous shapes provided that it allows welding access to the interior of brace 14. Access opening 38 is shown in the embodiment as a semicircular opening. Head brace 14 has a first side wall or tail 40 and a second side or tail 42. A main wall, or center wall, 44 connects tails 40 and 42. Tail 40 may be attached to main wall 44 with an angle therebetween, and similarly, tail 42 may be attached to another end of main wall 44 with a second angle therebetween.

Placement of head brace 14 is generally one of the final steps in attaching a draft sill to a tank. Frequently, head brace 14 may require a fair amount of trimming to get the desired fit between front sill pad 17 and draft sill assembly 12 without any gaps. Additionally, in some tank cars, it may be desirable to cut out portions of draft sill plate 50, which is a part of second portion 24 of draft assembly 12 to remove gaps. As shown in FIG. 4, it may be necessary to further cut a portion of draft sill plate 50 to remove any gaps between front sill pad 17 and draft sill plate 50. For example, in FIG. 4, it may be desirable to remove the portion designated with reference numeral 52. This will facilitate placing head brace 14 and securing the same to tank 10 with only minimal or no gaps between front sill pad 17, draft sill assembly 12, and head brace 14.

In attaching head brace 14 to draft sill assembly 12 according to the methods and apparatus of the present invention, there are numerous alternatives: whether surfaces are gouged or beveled, what type of welds are used, the order of welding, etc. The following detailed description is but one approach to securing head brace 14 to draft sill assembly 12 and head brace pad 17 according to the teachings of the present invention. It is to be understood that various changes, substitutions, and alterations can be made without departing from the spirit and scope of this invention, as defined by the appended claims.

Referring now to FIG. 5, head brace 14 is shown with bevels 60 that are added to the inside of head brace 14 on tails 40 and 42. FIG. 6 shows beveling cuts 60 in more detail. The outside portions of tails 40 and 42 are also beveled as shown in FIG. 6 with bevel cut 61. The exterior of head brace 14 has larger bevel cuts 62 on a portion of tail 40 and 42 as shown in FIG. 7; bevel cuts 62 are approximately 30–60 degrees. The outside portions of tails 40 and 42 may also be gouged during weld preparation as an alternative approach. Other alternatives to provide satisfactory welds are within the spirit of the invention as contemplated by the inventors.

Referring now to FIG. 8, the alignment of tail 40 or 42 with respect to head brace pad 17 and draft sill plate 50 is shown. During fabrication, tails 40 and 42 of head brace 14 will preferably be aligned so that the inside surface, e.g., 70 for tail 40, is substantially flush with interior surface 72 of draft sill plate 50. Alternatively, the alignment of tails 40 and 42 at head brace 14 with inside surface, e.g., 70 of tail 40, may be offset a small amount, such as 5/16 of an inch. Additionally, for some-applications, head brace 14 should be aligned such that the top of head brace 14 is a sufficient distance (in some situations, four and a half inches may be enough) from the top of front sill pad 17.

Once these tasks are complete, head brace 14 may be placed between front sill pad 17 and draft sill assembly 12, marked for trimming, and trimmed to fit appropriately. Once head brace 14 has been crafted to fit between front sill pad 17 and draft sill assembly 12 with no or very minor gaps, head brace 14 may be tack welded into position as shown in FIG. 9. Typically, great care should be taken in welding head brace 14 to the tank car since the welds joining head brace 14, front sill pad 17, and draft sill assembly 12 may be considered some of the most fatigue-sensitive components of a railway tank car. In this respect, the tack welds are preferably avoided at the corners, ends, or sides of head brace 14 above the vertical transition weld 32 on draft sill 12. One approach to making the tack welds is to first make weld 80, then weld 82, then weld 84, then weld 86, then weld 88, and finally weld 90; however, the exact order and number of tack welds may be varied to a great extent without serious complications.

Referring again to FIG. 3, once tack welds 80–90 are in place, the interior welds may be made. An important feature of the present invention includes providing accesses to the interior of head brace 14 through access opening 38. The first weld may be applied to top groove 92 of tails 40 and 42 to attach head brace 14 to front sill pad 17. Groove 92 may be filled using as many passes by the welder as desired. The weld in groove 92 may be tapered at the end of head brace 14 to allow a second weld along path 94 to tie into it.

Second weld 94 may be a horizontal weld, such as a fillet weld, that attaches a center filler plate 96 of sill assembly 12 to front sill pad 17 and a side plate 24 of draft sill assembly 12 to front sill pad 17. Weld 94 should preferably be continuous and should complete the fillet welds, but not necessarily groove welds 92, 93.

Typically the weld should pass the start of the CZ-bar of first part 22. As weld 93 progresses to the start of cut-out 98, the weld should cover the edge created by the cut-out 98.

A third weld 100 is a fillet weld that attaches head brace 14 to front sill pad 17. Weld 100 should be applied continuously and overlays groove weld 92 at tail 40, 42 of head brace 14 and goes around the corner of head brace 14. It could also be desirable to back gouge this area.

Referring now to FIG. 11, one approach for performing an initial exterior welding of head brace 14 is described. A multi-pass groove weld 110 may be applied on a lower front of head brace 14 and draft sill assembly 12; this groove weld 110 should not start or end at the corners, but starts at a point that may be approximately 2 inches from the corner of head brace 14 at the point designated by reference numeral 112. A weld is applied from point 112 around corner 114 and may terminate at point 116, which is about 2 inches from corner 114. Another groove weld 118 may then be applied starting at point 110 and continuing around corner 120 and terminating at point 122. An analogous procedure may be used to develop weld 126 on the top intersection of head brace 14 and front sill pad 17.

Referring now to FIG. 10, one approach to exterior gouging that may be used is described. Gouging may be used in the fabrication of the tank car to provide more complete and stronger connections. With draft sill assembly 12 usually in the upright position, the gouging is first started at a point inboard a small amount, e.g., four inches, of the intersection of head brace 14 and front sill pad 17; this point is designated 130 in FIG. 10. From point 130, the gouges continue outboard and stops upon gouging the weld terminations of weld 118 in the vicinity of point 122 of FIG. 11. Gouged groove 132 may be cleaned to remove dross and sharp irregularities. In gouging groove 132, the operator should take care to minimize the gouging of the CZ-bars of first portion 22.

A second gouge 134 is placed between head brace 14 and front sill pad 17. Gouge 134 is started at the intersection of first gouge 132 and the inboard end of tail 40 of head brace 14. Second gouge 134 is preferably about 4 inches long. Again, second gouge 134 is cleaned to remove dross and sharp irregularities. In producing second gouge 134, gouging of front sill pad 17 should be minimized. Gouges 132 and 134 should typically be deep enough into head brace 14 to provide sound metal for welding from the welds made on the interior side of head brace 14. With gouges 132 and 134 prepared, the exterior welding of head brace 14 may continue under this approach.

Referring to FIG. 11, other aspects of an approach to the exterior welding of head brace 14 are described. Next weld 138 attaches the sides of head brace 14 to front sill pad 17. Gouged groove 134 (FIG. 10) at the tail of head brace 14 is to be filled with multiple passes. The weld passes should be blended and smoothed at the bottom of this groove where it extends into horizontal groove 132 so that there will be a good tie into horizontal groove weld 132. The end of weld 138 transitions to the fillet welds of weld 126 at point 140 or 142. Next, an additional weld 144 is applied in groove 132.

Weld 144 fills gouged groove 132 between head brace 14 and draft sill assembly 12. Weld 144 is started in groove 132 and welded to point 122 where groove 132 ends. Typically, producing weld 144 may require numerous passes to fill in groove 132. Groove 132 may be filled in to be substantially smooth or flush to the surface of head brace 14. Analogous welds are made on the opposite side of head brace 14; e.g., weld 143 is analogous to weld 144.

Yet another weld 150 may be applied in securing tank 10 to draft sill assembly 12. Weld 150 may be applied from the intersection of bolster assembly 20 to the termination of weld 110 at points 116 and 122. This completes the welding process for securing head brace 14 according to one approach.

Referring now to FIG. 12, the metal-to-metal contact between front sill pad 17, tail 40 of head brace 14, and draft sill plate of second portion 24 of draft sill assembly 12 is shown. The cross-section shown in FIG. 12 is taken along line 12—12 of FIG. 11 after all welding is completed. As shown, the combination of welding and gouging allows for substantially all metal contact without gaps to be developed. This reduces the chances of fatigue cracks, which are, of course, undesirable.

Refer now to FIG. 13, another and preferred embodiment of head brace 314 is shown. Head brace 314 is similar in most respects to head brace 14 except that main wall 44 is replaced with a convex/concave or rounded or contoured main back wall 344. Tails 340 and 342 may also be contoured particularly near where they are attached to wall 344. Convex back wall 344 allows more loading of wall 344 instead of just primarily loading tails 40 and 42. The resultant load path of head brace 314 will distribute the loads over a greater area with respect to both top surface 36 and front sill pad 17 as compared to head brace 14. FIG. 13 also shows that the width of head brace 314 may be tapered inward as it goes from tails 340 and 342 towards wall 344 to allow for easier exterior welding on surface 344.

The curvature of convex main wall 344 may take any of a number of shapes that help to distribute the load, but one method for curving back wall 344 is shown in FIG. 14. FIG. 14 shows a portion of back wall 344 of contoured head brace 314 and a number of reference lines which will be described in more detail. FIG. 14 shows only half of head brace 314, but the other side is to be understood to be symmetric about reference line 416. Tangent line 400 depicts a point where curvature begins for a first curved portion.

Tangent line 404 depicts where the transition from a first curved portion 402 to a second curved portion numeral 406 occurs. First curved portion 402 has a radius of curvature shown by reference line 408, and second curved portion 406 has a radius of curvature shown by reference line 410. First curved portion 402 is curved over an arcuate segment that is approximately 63° and 26 minutes for the example shown, which is designated by reference numeral 412, and second curved portion 406 is curved through an angle designated 414 of approximately 26° and 34 minutes. Again, the portion shown of head brace 314 is only one side of center line 16, and the other side of head brace 314 is to be understood as being symmetric about center line 416. Mean head radius 420 is shown (mean head diameter equals two times the mean head radius 420).

Under the specific example, which is only one of many possibilities, first radius 408 would work out to be approximately 0.1727 times the mean diameter, and radius 410 would work out to be approximately 0.9045 times the mean diameter. In this embodiment, radius 410 is approximately the same as the transverse dimension of draft sill 12 and particularly surface 36. The two radii 408 and 410 are such that head brace 314 approximates a 2:1 elliptical shape. The footprint of head brace 314 on front sill pad 17 reflects the shape of pad 17 itself and substantially bisects the radial distance from the hole in pad 17 to the edge of pad 17.

Although the present invention and its advantages have been described in detail, it should be understood that various changes, substitutions and alterations can be made therein without departing from the spirit and scope of the invention as defined by the appended claims.

What is claimed is:

1. A method for attaching a head brace to a tank of a railway car having a draft sill assembly comprising the steps of:

cutting a top portion of the draft sill assembly proximate a tail portion of the head brace prior to attaching the head brace to form an access opening; and welding an interior portion of the head brace to a front sill pad on the tank and to the draft sill assembly through the access opening.

2. The method of claim 1 further comprising the step of welding an exterior portion of the head brace to the draft sill assembly and front sill pad.

3. The method of claim 2 wherein step of cutting a top portion of the draft sill assembly comprises the step of cutting a semicircular opening in the top portion of the draft sill assembly.

4. The method of claim 1 wherein step of cutting a top portion of the draft sill comprises the step of cutting a semicircular opening in the top portion of the draft sill.

5. An apparatus for securing a tank to a railway tank car, the apparatus comprising:

a head brace comprising:

a main wall, a first tail connected to the main wall at a first angle, and a second tail connected to the main wall at an angle; and a draft sill having a top surface and wherein the top surface is formed to have an access opening for accessing an interior portion of the head brace between the main wall and the first and second tails.

6. The apparatus of claim 5 wherein the head brace comprises a U-shaped head brace.

7. The apparatus of claim 6 wherein the access opening comprises a curvilinear opening in a top surface of the draft sill.

8. The apparatus of claim 5 wherein the draft sill is formed with the access opening in a semicircular shape.

9. The apparatus of claim 5 wherein the main wall of the head brace is a convex/concave wall.

10. The apparatus of claim 9 wherein the wall comprises a 2:1 elliptical shape.

11. The apparatus of claim 9 wherein the convex/concave wall has a first radius portion and second radius portion and wherein the second radius portion has a dimension approximately equal to the inside width of the top surface of the draft sill.

12. A method for attaching a head brace having tails to a draft sill and a head pad on railway tank car, the method comprising the steps of:

cutting a portion of the draft sill to form an access opening in the area where the tails will be disposed;

sizing the head brace to fit between the draft sill and head pad;

placing the head brace between the draft sill and head pad; and welding an interior portion of the head brace to the draft sill and to the head pad.

13. The method of claim 12 further comprising the steps of:

beveling portions of the tails of the head brace;

tack welding the head brace into place; and welding the exterior of the head brace to the draft sill and head pad.

14. The method of claim 13 further comprising the step of gouging portions of tails after welding the exterior and welding the exterior again to form a metal-on-metal contact between the head brace, draft sill, and head pad.

15. The method of claim 12 wherein the step of placing the head brace between the draft sill and head pad comprises aligning an interior surface of the head brace with an interior portion of the draft sill.

16. The method of claim 13 wherein the step of tack welding comprises tack welding on the exterior of the head brace.

17. The method of claim 13 further comprising gouging the exterior welds, and placing additional welds on the exterior of the head brace to create a metal-on-metal connection between the draft sill, head brace, and head pad.

* * * * *